US007189149B2

(12) United States Patent
Katayama et al.

(10) Patent No.: US 7,189,149 B2
(45) Date of Patent: Mar. 13, 2007

(54) METHOD OF TRUING CHAMFERING GRINDSTONE AND CHAMFERING DEVICE

(75) Inventors: Ichiro Katayama, Tsuchiura (JP); Youichi Nakamura, Tsuchiura (JP)

(73) Assignees: Tokyo Seimitsu Co., Ltd., Mitaka (JP); Tosei Engineering Corporation, Tsuchiura (JP)

( * ) Notice: Subject to any disclaimer, the term of this patent is extended or adjusted under 35 U.S.C. 154(b) by 0 days.

(21) Appl. No.: 10/989,513

(22) Filed: Nov. 17, 2004

(65) Prior Publication Data

US 2005/0112999 A1 May 26, 2005

(30) Foreign Application Priority Data

Nov. 26, 2003 (JP) ..... 2003-396029

(51) Int. Cl.
*B24B 53/00* (2006.01)

(52) U.S. Cl. ..... 451/56; 451/443

(58) Field of Classification Search ..... 451/56, 451/72, 443, 444, 44; 125/11.01, 11.03
See application file for complete search history.

(56) References Cited

U.S. PATENT DOCUMENTS

| | | | | | |
|---|---|---|---|---|---|
| 2,586,755 | A | * | 2/1952 | Wilson | 451/56 |
| 2,720,062 | A | * | 10/1955 | Fouguet | 451/21 |
| 4,953,522 | A | * | 9/1990 | Vetter | 125/11.01 |
| 5,209,020 | A | * | 5/1993 | Feisel | 451/11 |
| 5,595,528 | A | * | 1/1997 | Becker | 451/72 |

FOREIGN PATENT DOCUMENTS

| | | | | |
|---|---|---|---|---|
| JP | 58-155170 | * | 9/1983 | 125/11.03 |
| JP | 60-150965 | * | 8/1985 | 125/11.03 |
| JP | 2-218555 | * | 8/1990 | 125/11.01 |
| JP | 11-347901 | | 12/1999 | |

* cited by examiner

*Primary Examiner*—Robert A. Rose
(74) *Attorney, Agent, or Firm*—David S. Safran

(57) ABSTRACT

A truing method for a chamfering grindstone for performing chamfering work on a peripheral edge of a plate-shaped object, comprising the steps of: performing chamfering work on a truing grindstone with a master grindstone having a desired groove shape and forming a peripheral edge shape of the truing grindstone into a desired chamfered shape; and transferring the groove shape of the master grindstone onto the chamfering grindstone by performing grooving work on the chamfering grindstone with the chamfered truing grindstone to form the groove in the desired shape on the chamfering grindstone.

8 Claims, 10 Drawing Sheets

METHOD OF TRUING CHAMFERING GRINDSTONE AND CHAMFERING DEVICE

BACKGROUND OF THE INVENTION

1. Field of the Invention

The present invention relates to method of truing a chamfering grindstone and a chamfering device, and particularly relates to method of truing a chamfering grindstone which chamfers wafers for a semiconductor device, an electronic component and the like, and a chamfering device.

2. Description of the Related Art

Metal or resin is mainly used as a binder for a grindstone for performing chamfering work on a wafer of silicone or the like that is a material of high fragility.

A metal-bond grindstone has the advantage of having high abrasive grain holding power, but it is difficult to accurately align the center of a grindstone and the center of a spindle when the grindstone is mounted to a spindle even if strict tolerance is established, and therefore the metal-bond grindstone has the disadvantage of causing runout in an outer periphery.

On the other hand, a resin-bond grindstone does not have high abrasive grain holding power, but has the advantage of being able to suppress the occurrence of runout by newly creating a groove on the grindstone (groove for chamfering work) by carrying out truing after the grindstone is attached to the spindle.

However, when the resin-bond grindstone is trued with a chamfering device, a truing mechanism is additionally needed, and there is the disadvantage that the entire chamfering device becomes large in size and complicated with the truing mechanism associated with the chamfering device.

There has been proposed the truing tool and the wafer chamfering device with the truing tool which can perform truing of the grindstone with a simple mechanism as the device for compensating such a disadvantage (see Japanese Patent Application Publication No. 11-347901).

In this truing tool and the wafer chamfering device with the truing tool, by using the truing tool in which the truing grindstone formed into a predetermined shape is fixed to an outer peripheral part of a base material formed into a disc-shape, this truing tool is mounted on the same axis as the wafer table, and the wafer table and the grindstone are rotated to be relatively closer to each other, whereby an outer peripheral part of the truing tool is brought into contact with the outer periphery of the grindstone to true the grindstone.

However, in the truing method described in Japanese Patent Application Publication No. 11-347901, the truing tool of which outer peripheral part is formed into a predetermined shape is mounted on the same axis as the wafer table, but when the truing tool is worn and deformation occurs, or when the chamfering shape of the wafer is changed, another new truing tool has to be mounted again.

Each time a new truing tool is mounted, the truing tool has to be centered with respect to the rotational axis, and thus skilled technicians spend tremendous time in replacing the truing tools.

SUMMARY OF THE INVENTION

The present invention is made in view of the above circumstances, and has its object to provide a truing method and a chamfering device which can easily true the shape of the groove on the chamfering grindstone used for a device for chamfering a plate-shaped object into a desired shape.

In order to attain the above-described object, the present invention is, in a truing method for a chamfering grindstone for performing chamfering work on a peripheral edge of a plate-shaped object, characterized by including the steps of performing chamfering work on a truing grindstone with a master grindstone having a desired groove shape and forming a peripheral edge shape of the truing grindstone into a desired chamfered shape, and transferring the groove shape of the master grindstone onto the chamfering grindstone by performing grooving work on the chamfering grindstone with the chamfered truing grindstone to form the groove in the desired shape on the chamfering grindstone.

According to the truing method for the chamfering grindstone of the present invention, the groove is formed on the chamfering grindstone by transferring the groove shape of the master grindstone onto the outer periphery of the truing grindstone and transferring the outer peripheral shape of the truing grindstone onto the chamfering grindstone, and therefore the groove in the desired shape can be easily formed on the chamfering grindstone with high precision. If the truing grindstone is worn and deformation occurs, the truing grindstone can be easily repaired.

The present invention makes it an additional feature that a GC (Green silicon carbide) grindstone, or a WA (White fused alumina) grindstone is used for the truing grindstone, makes it an additional feature that a metal-bond diamond grindstone or a diamond-electrodeposited grindstone is used for the master grindstone and a resin-bond diamond grindstone is used for the chamfering grindstone, and makes it an additional feature that the chamfering grindstone which is trued is a grindstone for finish grinding.

According to this, the chamfering grindstone is a chamfering grindstone for finish grinding and resin-bond diamond grindstone, and therefore it is excellent in cutting quality, thus providing a favorable finished surface. Due to the resin-bond grindstone, truing can be performed with a truing grindstone of a GC grindstone or WA grindstone, and since the truing grindstone is a GC grindstone or a WA grindstone, the truing grindstone can be easily formed with the master grindstone constituted of a metal-bond diamond grindstone or a diamond-electrodeposited grindstone.

The present invention makes it an additional feature that in consideration of a shape offset amount which occurs at the time of the transfer of the groove shape, the shape offset amount is previously reflected in the shape of the groove on the master grindstone.

According to this additional feature, in transferring the groove shape of the master grindstone onto the chamfering grindstone via the truing grindstone, the transferred shape offset amount which occurs due to runout, deflection and the like of each of the grindstones is previously reflected in the shape of the groove on the master grindstone, and therefore the groove shape of the chamfering grindstone can be formed with high precision.

The present invention makes it an additional feature that when the chamfering work is performed on the truing grindstone with the master grindstone and a sectional shape of the groove formed on the master grindstone is transferred as a sectional shape of the peripheral edge of the truing grindstone, the master grindstone and the truing grindstone are relatively moved to change a transferred shape by a predetermined amount, and further makes it an additional feature that when the grooving work is performed on the chamfering grindstone with the truing grindstone, and the groove shape of the master grindstone is transferred onto the chamfering grindstone, the truing grindstone and the chamfering grindstone are relatively moved to change a transferred shape by a predetermined amount.

According to this, the transferred shape correcting operation is performed in transfer to the truing grindstone from the master grindstone and transfer to the chamfering grindstone from the truing grindstone, and therefore the groove shape which is changed to a desired groove shape from the groove shape of the master grindstone can be formed. Accordingly, chamfering work can be performed so that the final chamfered shape of the plate-shaped object becomes a desired shape.

The present invention makes it an additional feature to further include the steps of performing chamfering work on the peripheral edge of the plate-shaped object by using the trued chamfering grindstone, measuring the sectional shape of the peripheral edge of the plate-shaped object after the work, and correcting a moving amount of the relative movement in accordance with a measured value of the sectional shape.

According to this, the sectional shape of the peripheral edge of the chamfered plate-shaped object is measured, and the value is fed back to the transferred shape correcting operation. Therefore, chamfering work can be performed on the plate-shaped object in an accurate sectional shape.

A chamfering device of the present invention is, in a chamfering device for performing chamfering work on a peripheral edge of a plate-shaped object, characterized by including a master grindstone which is provided on the same axis as an outer periphery rough grinding grindstone for roughly chamfering the peripheral edge of the plate-shaped object and has a desired groove shape, a truing grindstone provided on the same axis as a rotational axis of a mounting table which rotates with the plate-shaped object mounted on the mounting table, and a fine grinding grindstone which performs finish chamfering of the peripheral edge of the plate-shaped object, and characterized in that chamfering work is performed on the truing grindstone with the master grindstone and the peripheral edge shape of the truing grindstone is formed into a desired chamfered shape, the groove shape of the master grindstone is transferred onto the fine grinding grindstone by performing grooving work on the fine grinding grindstone with the chamfered truing grindstone to perform truing for forming the groove in a desired shape on the fine grinding grindstone, and the finish chamfering of the peripheral edge of the plate-shaped object is performed with the trued fine grinding grindstone.

According to the chamfering device of the present invention, the groove is formed on the chamfering grindstone by transferring the groove shape of the master grindstone provided on the same axis as the outer peripheral rough grinding grindstone onto the outer periphery of the truing grindstone provided on the same axis as the rotational axis of the mounting table, and transferring the outer peripheral shape of the truing grindstone onto the chamfering grindstone, and therefore the groove in a desired shape can be easily formed on the chamfering grindstone on machine with high precision. Even if the truing grindstone is worn and deformation occurs, the truing grindstone can be easily repaired on machine.

The chamfering device of the present invention makes it an additional feature to include a controller for relatively moving the master grindstone and the truing grindstone to change the transferred shape by a predetermined amount when the chamfering work is performed on the truing grindstone with the master grindstone, and the sectional shape of the groove formed on the master grindstone is transferred as the sectional shape of the peripheral edge of the truing grindstone, and makes it an additional feature to include a controller for relatively moving the truing grindstone and the fine grinding grindstone to change the transferred shape by a predetermined amount when the grooving work is performed on the fine grinding grindstone with the truing grindstone and the groove shape of the master grindstone is transferred onto the fine grinding grindstone.

According to this additional feature, the transferred shape correcting operation can be made in transfer to the truing grindstone from the master grindstone and in transfer to the chamfering grindstone from the truing grindstone, and therefore the groove shape which is changed from the groove shape of the master grindstone to a desired groove shape can be formed. Accordingly, chamfering work can be performed so that the finish chamfered shape of a plate-shaped object is in a desired shape.

The chamfering device of the present invention makes it an additional feature to include a measuring machine for measuring the sectional shape of the peripheral edge of the plate-shaped object after the chamfering work, and that the controller corrects the moving amount of the relative movement in accordance with a measured value of the sectional shape.

According to this, the sectional shape of the peripheral edge of the chamfered plate-shaped object is measured, and the value is fed back to the transferred shape correcting operation, thus making it possible to perform chamfering work on the plate-shaped object in an accurate sectional shape.

As explained above, according to the truing method for a chamfering grindstone and a chamfering device, the groove is formed on the chamfering grindstone by transferring the groove shape of the master grindstone onto the outer periphery of the truing grindstone, and transferring the outer peripheral shape of the truing grindstone onto the chamfering grindstone, and therefore the groove on a desired shape can be easily formed on the chamfering grindstone with high precision. Even if the truing grindstone is worn and deformation occurs, the truing grindstone can be easily repaired.

DETAILED DESCRIPTION OF THE PREFERRED EMBODIMENTS

Figure 1:
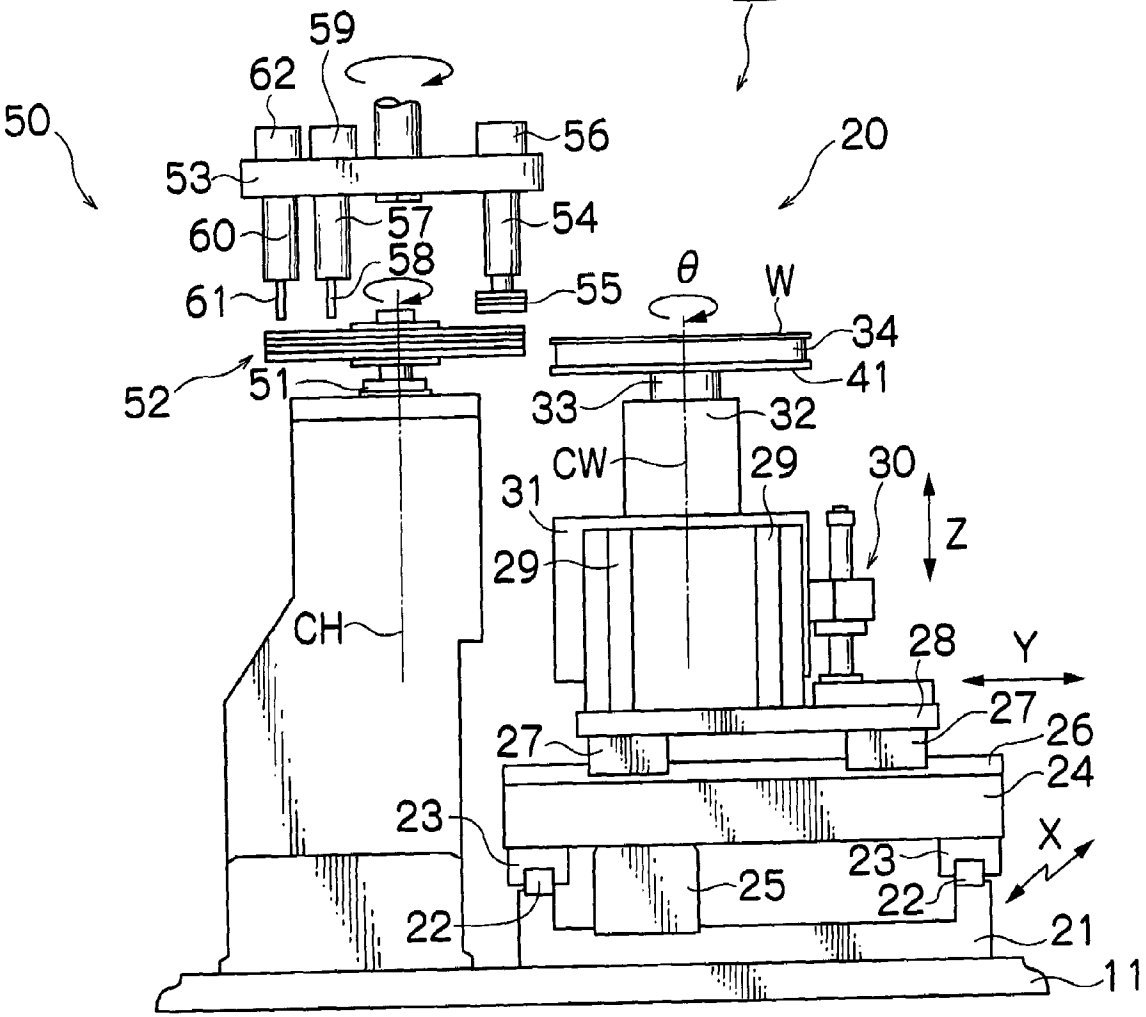
FIG. 1 is a front view showing a chamfering device according to embodiments of the present invention.

A preferred embodiment of a method of truing a chamfering grindstone and a chamfering device according to the present invention will be explained in detail in accordance with the attached drawings hereinafter. In each of the drawings, the same reference numerals and characters are given to the same components.

First of all, the chamfering device of a wafer (plate-shaped object) which is used in the truing method according to the present invention will be explained. FIG. 1 is a front view showing a main part of the chamfering device. A chamfering device 10 is constructed by a wafer feeding unit 20, a grindstone rotating unit 50, a wafer supplying/housing unit, a wafer cleaning/drying unit and a wafer conveying device which are not shown, a controller 15, which will be shown later and controls an operation of each unit of the chamfering device, and the like.

The wafer feeding unit 20 has an X table 24 which is moved in the X-direction in the drawing by an X-axis base 21 mounted on a body base 11, two X-axis guide rails 22 and 22, four X-axis linear guides 23, 23, . . . , and an X-axis driving device 25 constituted of a ball screw and a stepping motor.

A Y table 28, which is moved in the Y-direction in the drawing by two Y-axis guide rails 26 and 26, four Y-axis linear guides 27, 27, . . . , a Y-axis driving device constituted of a ball screw and a stepping motor not shown, is incorporated into the X table 24.

A Z table 31, which is guided by two Z-axis guide rails 29 and 29 and four Z-axis linear guides not shown and is moved in the Z direction in the drawing by a Z-axis driving device 30 constituted of a ball screw and a stepping motor is incorporated into the Y table 28.

A θ-axis motor 32 and a θ spindle 33 are incorporated into the Z table 31, and a wafer table (mounting table) 34 on which a wafer W that is a plate-shaped object is mounted by suction is attached to the θ spindle 33. The wafer table 34 is rotated in the θ-direction in the drawing around a wafer table rotational axis CW.

A truing grindstone 41 (hereinafter also called a truer 41), which is used for truing the grindstone that performs finish chamfering for the peripheral edge of the wafer W, is attached to a lower part of the wafer table 34 coaxially with the wafer table rotational axis CW.

The wafer W and the truer 41 are rotated in the O-direction in the drawing and moved in the X, Y and Z directions by this wafer feeding unit 20.

The grindstone rotating unit 50 has an outer periphery grindstone spindle 51 to which an outer periphery working grindstone 52 is attached, and which is rotationally driven around an axis CH by an outer periphery grindstone motor not shown, an outer periphery fine grinding spindle 54 and an outer periphery fine grinding motor 56 attached to a turn table 53 which is disposed above the outer periphery working grindstone 52, a notch rough grinding spindle 60 and a notch rough grinding motor 62, and a notch fine grinding spindle 57 and a notch fine grinding motor 59.

An outer periphery fine grinding grindstone 55 which is a chamfering grindstone for performing finish grinding for the outer periphery of the wafer W is attached to the outer periphery fine grinding spindle 54, a notch rough grinding grindstone 61 is attached to the notch rough grinding spindle 60, and a notch fine grinding grindstone 58 that is a chamfering grindstone for performing finish grinding of a notch portion is attached to the notch fine grinding spindle 57.

The outer periphery fine grinding grindstone 55, the notch fine grinding grindstone 58 and the notch rough grinding grindstone 61 are positioned at the respective working positions by the rotation of the turn table 53.

Figure 2:
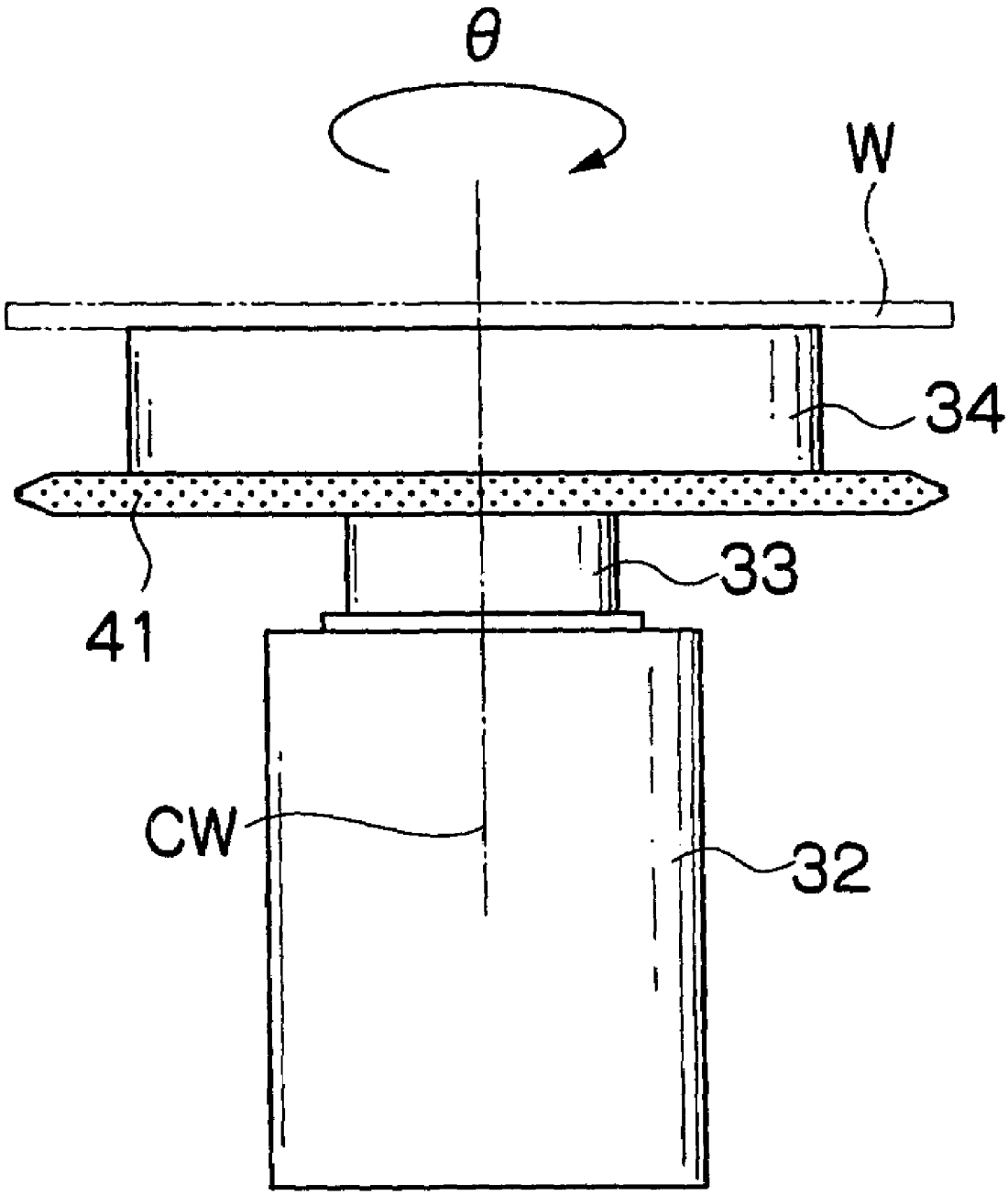
FIG. 2 is an enlarged view around a wafer table.

FIG. 2 shows the truer 41 attached to the wafer table 34. The truer 41 is attached to the lower part of the wafer table 34 coaxially with the wafer table rotational axis CW, and is rotated in the θ-direction by the θ-axis motor 32, as shown in FIG. 2. The top surface of the wafer table 34 is a suction surface communicating with a vacuum source not shown, and the wafer W to be subjected to chamfering work is placed on the top surface of the wafer table 34 and fixed by suction.

Figure 3:
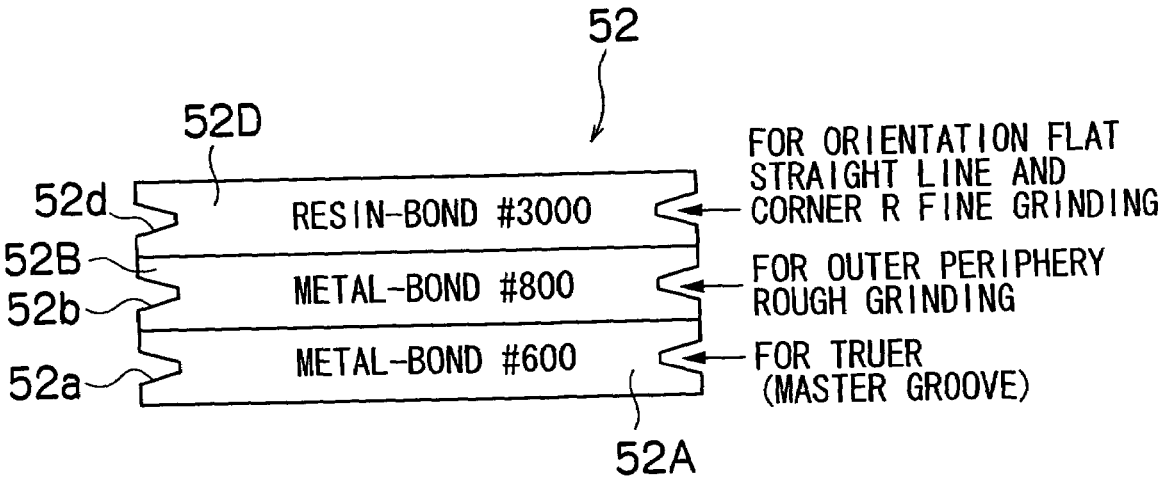
FIG. 3 is a conceptual diagram explaining an outer periphery working grindstone.

FIG. 3 shows a construction of the outer periphery working grindstone 52. The outer periphery working grindstone 52 has a three-stage construction. A lowermost part is a master grindstone 52A having a master groove 52*a* forming an outer peripheral shape of the truer 41, and a middle part is an outer periphery rough grinding grindstone 52B on which an outer peripheral rough grinding groove 52*b* for the wafer W is formed. An uppermost part is an orientation flat and orientation flat corner fine grinding grindstone 52D that is a chamfering grindstone on which an orientation flat and orientation flat corner fine grinding groove 52*d* for the wafer W is formed and which performs finish grinding of orientation flat and orientation flat corner.

Though one groove is illustrated in each of the grindstones in FIG. 3 to simplify the explanation, a plurality of groove are actually formed in each of the grindstones in order to cope with the deformation of the groove shape due to abrasion.

In this embodiment, for the truer 41, a disc-shaped GC grindstone of substantially the same diameter and the same thickness as the wafer W to be worked is used, and the grain size of the grinding stone is #320.

The master grindstone 52A is a metal-bond grindstone of diamond abrasive grain with the diameter of 202 mm, and has the grain size of #600. The outer periphery rough grinding grindstone 52B is a metal-bond grindstone of diamond abrasive grain with the diameter of 202 mm, and has the grain size of #800. The orientation flat and orientation flat corner fine grinding grindstone 52D is a resin-bond grindstone of the diamond abrasive grain with the diameter of 202 mm, and has the grain size of #3000.

The outer periphery fine grinding grindstone 55 is a resin-bond grindstone of diamond abrasive grain with the diameter of 50 mm, and has the grain size of #3000. For the notch rough grinding grindstone 61, a resin-bond grinding stone of diamond abrasive grain, which is small in diameter with the diameter of 1.8 mm to 2.4 mm and has the grain size of #800, is used. For the notch fine grinding grindstone 58, a resin-bond grindstone of diamond abrasive grain, which is small in diameter with the diameter of 1,8 mm to 2.4 mm and has the grain size of #4000, is used.

The outer periphery grindstone spindle 51 is the spindle driven by a built-in motor using a ball bearing, and is rotated at the rotational speed of 8000 rpm. The outer periphery fine grinding spindle 54 is a spindle driven by a built-in motor using an air bearing, and is rotated at the rotational speed of 35000 rpm.

The notch rough grinding spindle 60 is a spindle driven by an air turbine using an air bearing, and is rotate at the rotational speed of 80000 rpm. The notch fine grinding spindle 57 is the spindle driven by a built-in motor using an air bearing and is rotated at the rotational speed of 150000 rpm.

The detailed explanation of the other construction part of the chamfering device 10 will be omitted, because the mechanism is generally well known.

Next, a truing method according to the present invention will be explained. First of all, chamfering work is performed on the outer periphery of the truer 41 with the master grindstone 52A. In this work, the master grindstone 52A is rotated at the rotational speed of 8000 rpm. The Z table 31 is moved by the Z-axis driving device 30 in this state, and the height of the truer 41 is positioned at the height corresponding to the master groove 52*a* of the master grindstone 52A.

Figure 4A:
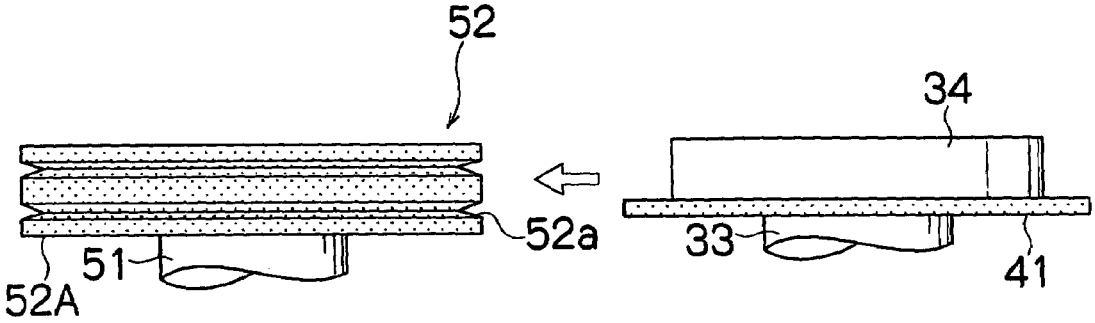
FIGS. 4A to 4C are conceptual diagrams showing a truing method according to an embodiment of the present invention.

Next, the Y table 28 is moved toward the master grindstone 51A. FIG. 4A shows this state. By the movement of the Y table 28 in the Y-direction, the outer peripheral part of the truer 41 is cut in the master groove 52*a* of the master grindstone 52A, and the wafer table 34 slowly makes one rotation by the θ-axis motor 32, whereby the outer peripheral part of the truer 41 is chamfered, and the shape of the master groove 52*a* is transferred onto the outer peripheral part of the truer 41.

Figure 4B:
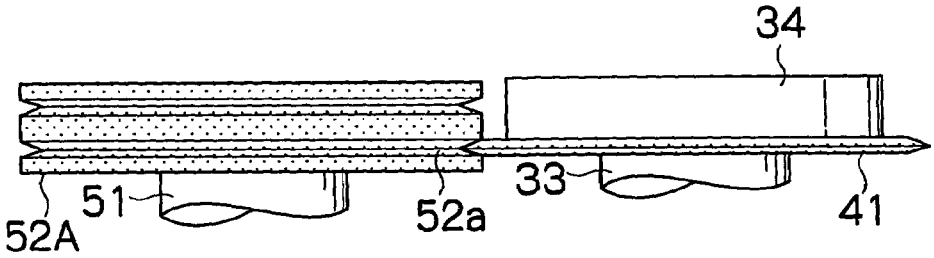
Figure 4C:
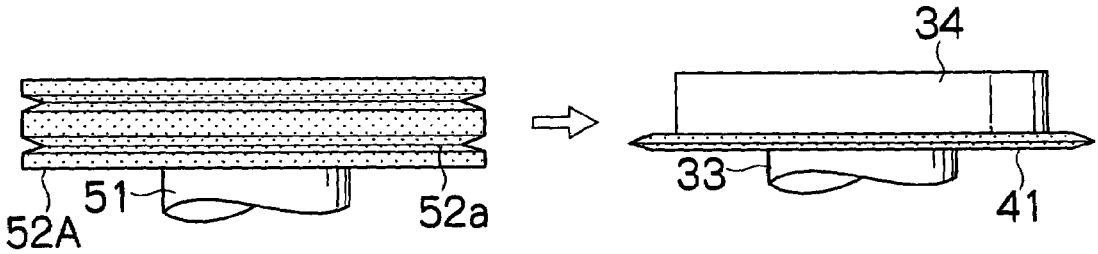

FIG. 4B shows this state. Next, as shown in FIG. 4C, the truer 41 is moved in the direction to be away from the master grindstone 52A, and the transfer from the sectional shape of the master groove 52*a* of the master grindstone 52A to the sectional shape of the outer peripheral part of the truer 41 is finished.

Figure 5A:
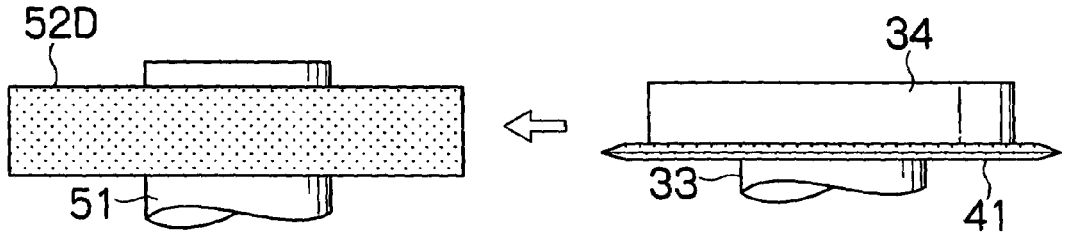
FIGS. 5A to 5C are conceptual diagrams showing a truing method according to the embodiment of the present invention (continued)
Figure 5B:
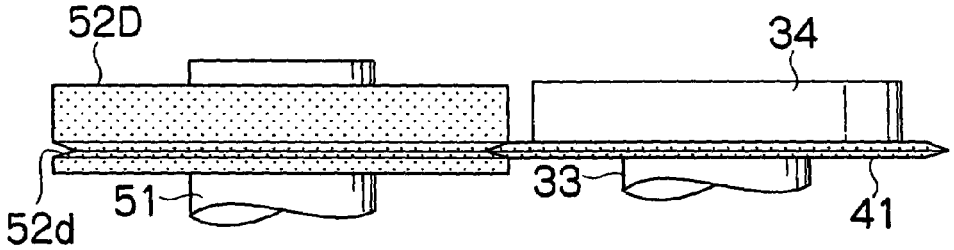
Figure 5C:
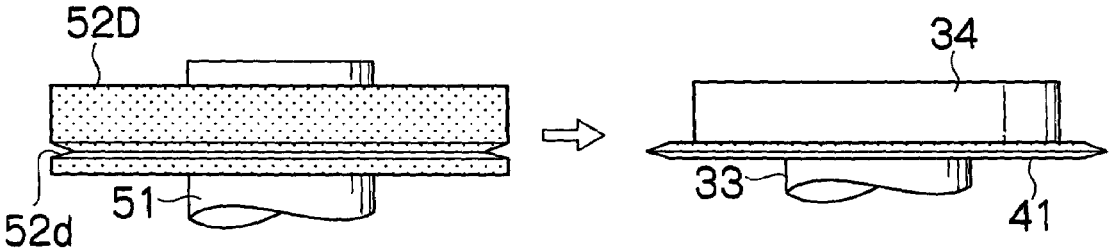

Next, by using the truer 41 to which outer peripheral part the sectional shape of the master groove 52*a* is transferred, the fine grinding groove 52*d* is formed on the orientation flat and orientation flat corner fine grinding grindstone 52D. In this process step, the Z table 31 is moved by the Z-axis driving device 30 first, and the height of the truer 41 is positioned at the groove forming position of the orientation flat and orientation flat corner fine grinding grindstone 52D, as shown in FIG. 5A.

Next, the truer 41 is rotated at high speed and moved in the Y-direction, and cuts into the orientation flat and orientation flat corner fine grinding grindstone 52D, and the orientation flat and orientation flat corner fine grinding grindstone 52D slowly makes one rotation, whereby the fine grinding groove 52*d* is formed. Next, the truer 41 is returned in the Y-direction, and the forming work of the fine grinding groove 52*d* on the orientation flat and orientation flat corner fine grinding grindstone 52D is finished.

The sectional shape of the master groove 52*a* of the master grindstone 52A is transferred onto the outer peripheral part of the truer 41, and is transferred onto the orientation flat and orientation flat corner fine grinding grindstone 52D from the truer 41, whereby the sectional shape of the master groove 52*a* of the master grindstone 52A is transferred as the fine grinding groove 52*d* of the orientation flat and orientation flat corner fine grinding grindstone 52D.

As for formation of the fine grinding groove onto the outer periphery fine grinding grindstone 55, the sectional shape of the master groove 52*a* of the master grindstone 52A is formed by transfer via the truer 41 as the fine grinding groove 52*d* of the orientation flat and orientation flat corner fine grinding grindstone 52D.

Formation of the fine grinding groove onto the notch fine grinding grindstone 58 is performed in quite the same manner, and the sectional shape of the master groove 52*a* of the master grindstone 52A is formed by transfer via the truer 41.

The finish grinding of the chamfering work on the wafer W is performed by using the outer periphery fine grinding grindstone 55, the orientation flat and orientation flat corner fine grinding grindstone 52D, or the notch fine grinding grindstone 58, which is trued as described above.

As described above, the sectional shape of the master groove 52*a* of the master grindstone 52A is transferred onto the outer peripheral part of the truer 41 and the fine grinding grindstone is trued by using this truer 41. Therefore, the operation of centering with high precision of the truer 41 and the fine grinding grindstone with respect to each of the rotational axes is not required, and truing can be performed with the same process steps as the chamfering work on the wafer W. Therefore, highly precise truing can be easily performed on machine. It is not necessary to provide a large-scale truing device in the chamfering device 10.

Figure 6A:
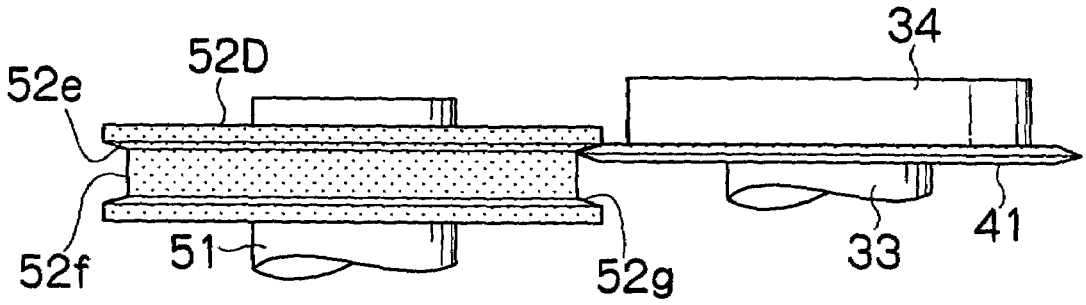
FIGS. 6A and 6B are conceptual diagrams showing another truing operation.
Figure 6B:
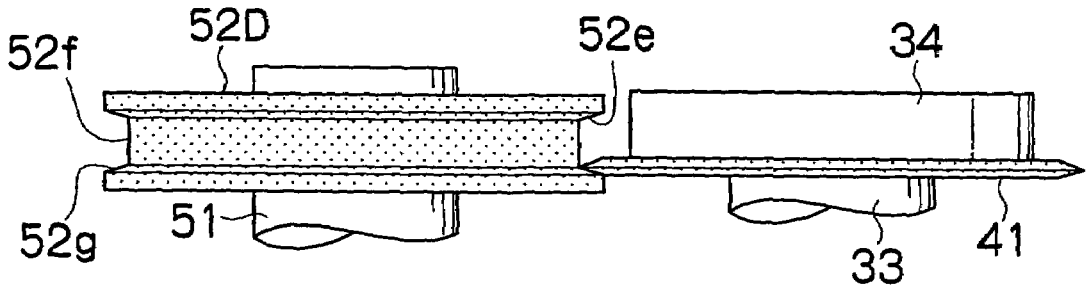

In the aforementioned embodiment, the explanation is made with the example of truing of the form grinding, but the present invention can be also carried out in truing of a normal grooved grindstone. Namely, as shown in FIG. 6A, an upper side surface 52*e* of the groove is trued by the truer 41 first, then as shown in FIG. 6B, a groove bottom 52*f* is formed as lowering the truer 41 next, and finally, a lower side surface 52*g* of the groove is trued, whereby the side surface shape of the master groove 52*a* can be transferred onto the upper side surface 52*e* and the lower side surface 52*g*.

Figure 7:
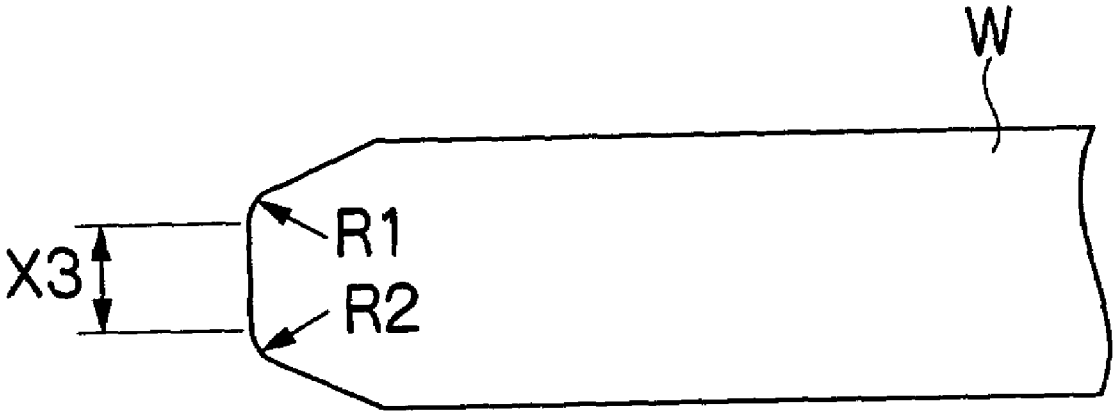
FIG. 7 is a partial sectional view showing a chamfered section of a wafer.

Next, correction of the truing shape will be explained. In the chamfering work on the wafer W, a length X3 of the linear portion of the side surface of the wafer W, and the dimensions of radius of curvatures R1 and R2 of the connecting portion of the linear portion of the side surface and the chamfering inclined portions as shown in FIG. 7 are generally regarded as important.

Incidentally, the master groove 52*a* of the aforementioned master grindstone 52A is precisely worked by putting a lot of time into electric discharge machining or the like, but at the time of transfer to the truer 41 from the master grindstone 52A, and at the time of transfer to the fine grinding grindstone from the truer 41, the shape of the master groove 52*a* of the master grindstone 52A cannot be transferred onto the fine grinding grindstone as accurately as it is due to runout and deflection occurring to the truer 41 and each of the grindstones.

Accordingly, in the truing method according to this embodiment, a transfer offset amount occurring due to runout and deflection of the truer 41 and each of the grindstones is previously measured, and the master groove 52*a* of the master grindstone 52A is designed in consideration of the transfer offset amount. Thereby, a predetermined groove shape can be formed on the fine grinding grindstone.

Figure 8:
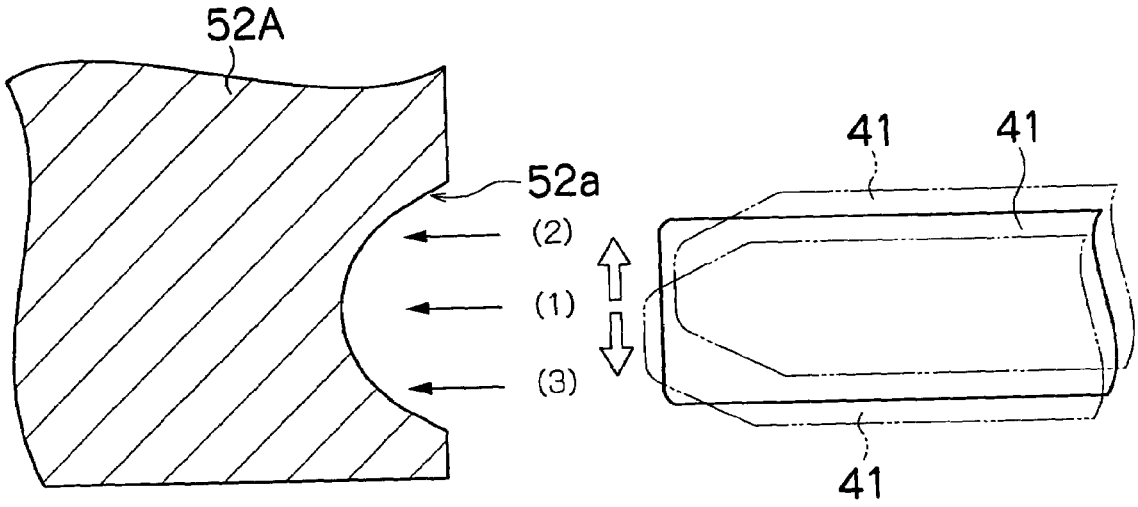
FIG. 8 is a conceptual diagram explaining a truing correcting operation.

In another embodiment, a truing correcting operation as shown in FIG. 8 is programmed into the controller 15, and a truing correcting operation is performed at the time of truing. For example, in the case in which the length X3 of the linear portion of the side surface is made small when transfer is performed to the truer 41 from the master groove 52*a* of the master grindstone 52A, the truer 41 is cut toward the center of the master groove 52*a* first (1), next, the truer 41 is raised by ½ of the correction amount of the X3 and cut (2), and finally, the truer 41 is lowered from the first height by ½ of the correction amount of X3 and cut (3), as shown in FIG. 8. By such a correcting operation being performed, transfer can be made with the X3 made small.

Figure 9:
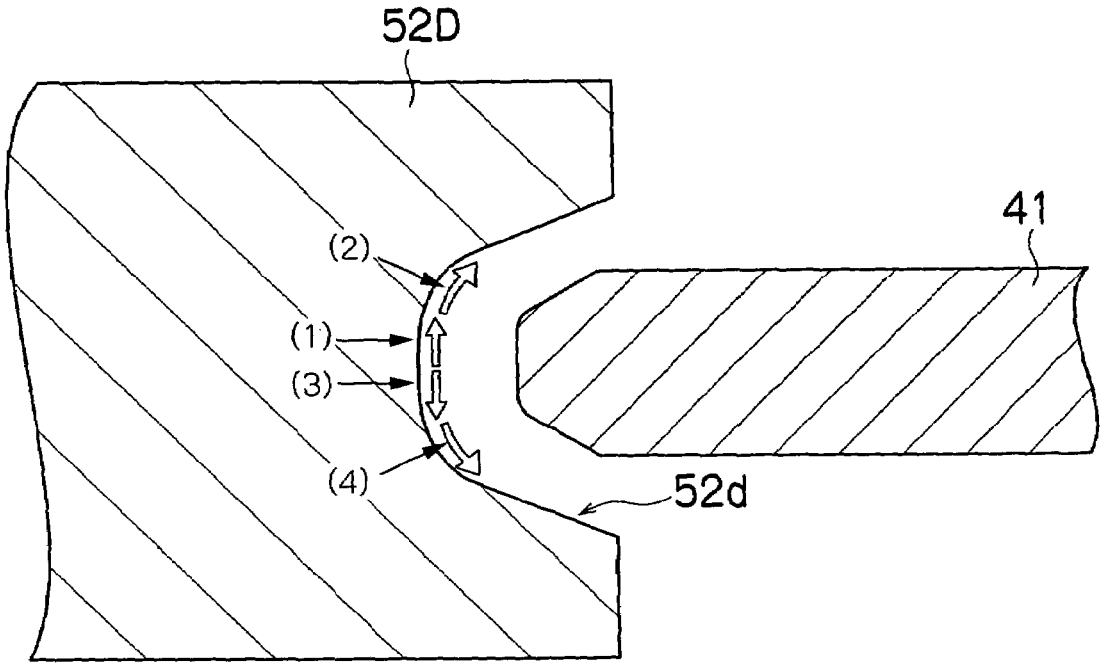
FIG. 9 is a conceptual diagram explaining another truing correcting operation.

For example, in the case in which the X3, R1 and R2 are made large when the transfer truing is performed on the fine grinding grindstone from the truer 41, after the truer 41 cuts into the fine grinding grindstone, the truer 41 is moved upward and widens the X3 by ½ of the correction amount of the X3 (1), and then the R1 is made larger by moving the truer 41 in the retreating direction while moving the truer 41 upward, as shown in FIG. 9. Next, the truer 41 is lowered downward by ½ of the correction amount of the X3 from the position at which the truer 41 firstly cuts into the fine grinding grindstone (3), and finally, the R2 is made large by moving the truer 41 in the retreating direction while moving the truer 41 downward.

By performing such a correcting operation, the X3, R1 and R2 can be trued to a large extent.

In this other embodiment, not only the correction of the transfer offset amount, but also the case in which the chamfering shape changes due to a change in the kind of the wafer W can be handled by this correcting operation as long as the change amount is not so large.

Figure 10:
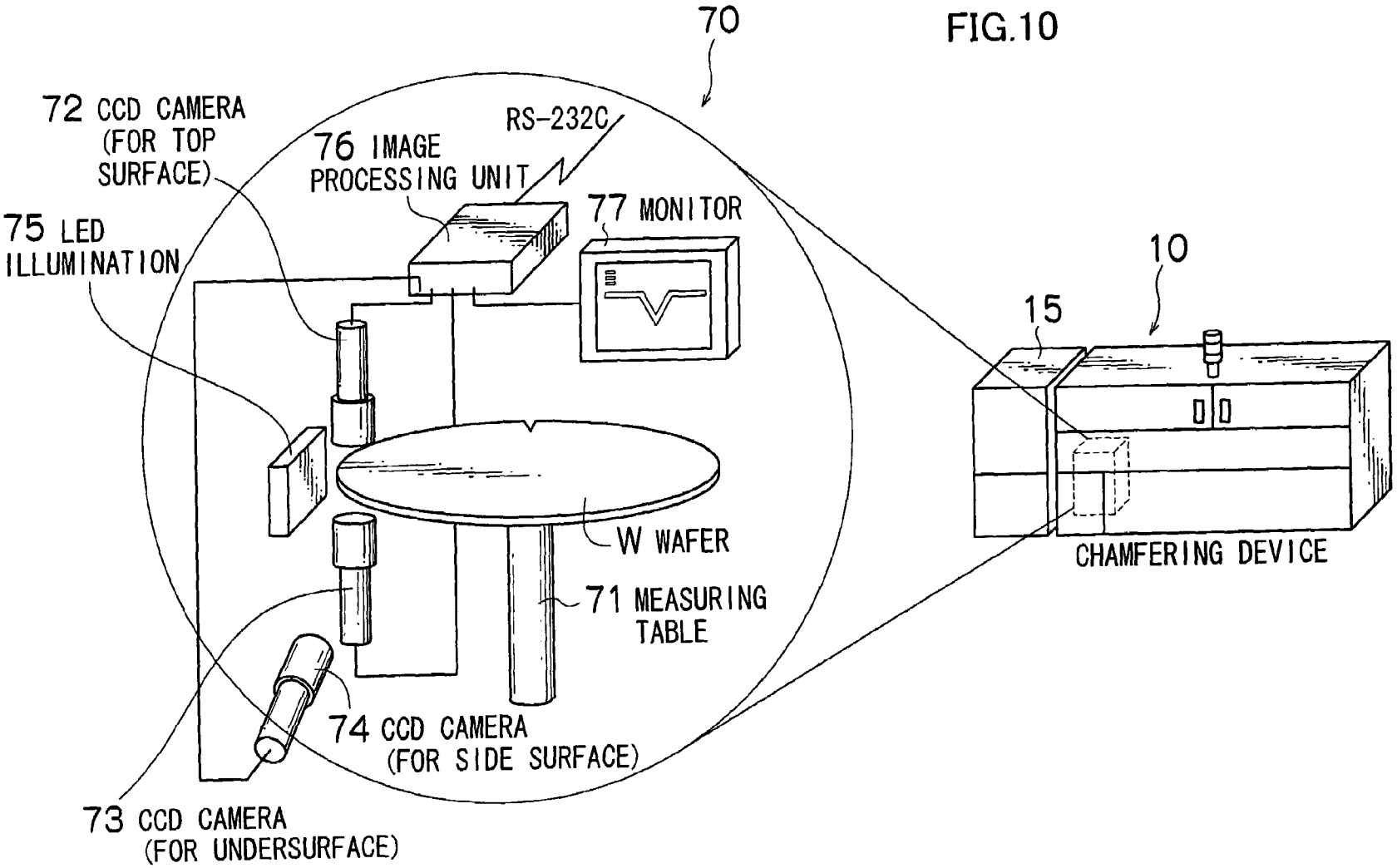
FIG. 10 is a conceptual diagram showing a chamfered shape measuring device.

FIG. 10 is a conceptual diagram showing a measuring device (measuring machine) 70, which is provided at the chamfering device 10 and measures the chamfering state of the wafer W. The measuring device 70 is constructed by a measuring table 71 rotatable with the wafer W mounted thereon, a CCD camera (for the top surface) 72 which is disposed at the peripheral edge of the wafer W and picks up the image of the chamfering shape, a CCD camera (for the undersurface) 73, a CCD camera (for the side surface) 74, an LED lighting device 75, an image processing unit 76, a monitor 77 and the like.

Peripheral edge portion images of the wafer W picked up by the CCD camera (for the top surface) 72, the CCD camera (for the undersurface) 73, the CCD camera (for the side surface) 74 are subjected to signal processing in the image processing unit 76 and transmitted to the controller, and the chamfering shape dimensions are arithmetically operated.

The controller 15 can control the truing correcting operation according to the chamfering shape dimension of the wafer W obtained by this measuring device 70, and therefore the optimum truing to obtain a desired chamfering shape can be easily carried out on machine.

The peripheral edge portion shape of the truer 41 for which chamfering work is performed by the master grindstone 52A is measured with the measuring device (measuring machine) 70, and the chamfering correcting operation of the truer 41 can be controlled according to the obtained measured data.

After a predetermined number of chamfering works are performed, optimal truing can be carried out automatically, and therefore favorable chamfering work can be always performed.

In the aforementioned embodiment, the explanation is made with the material, size, grain size, rotational speed and the like of the truer 41 and each of the grindstones specified, but the present invention is not limited to this, and as long as the groove shape of the master groove 52*a* of the master grindstone 52A can be transferred to the truer 41 and can be transferred to the grindstone for work from the truer 41, the present invention can be applied to various kinds of materials, sizes, grain sizes, rotational speeds and the like.

What is claimed is:

1. A truing method for a chamfering grindstone for performing chamfering work on a peripheral edge of a plate-shaped object, comprising the steps of:

performing chamfering work on a truing grindstone with a master grindstone having a desired groove shape and forming a peripheral edge shape of the truing grindstone into a desired chamfered shape; and transferring the groove shape of the master grindstone onto the chamfering grindstone by performing grooving work on the chamfering grindstone with the chamfered truing grindstone to form the groove in the desired shape on the chamfering grindstone; wherein, in consideration of a shape offset amount which occurs at the time of the transfer of the groove shape, the shape offset amount is previously reflected in the shape of the groove on the master grindstone.

2. A truing method for a chamfering grindstone for performing chamfering work on a peripheral edge of a plate-shaped object, comprising the steps of:

performing chamfering work on a truing grindstone with a master grindstone having a desired groove shape and forming a peripheral edge shape of the truing grindstone into a desired chamfered shape; and transferring the groove shape of the master grindstone onto the chamfering grindstone by performing grooving work on the chamfering grindstone with the chamfered truing grindstone to form the groove in the desired shape on the chamfering grindstone; wherein when the chamfering work is performed on the truing grindstone with the master grindstone and a sectional shape of the groove formed on the master grindstone is transferred as a sectional shape of the peripheral edge of the truing grindstone, the master grindstone and the truing grindstone are relatively moved to change a transferred shape by a predetermined amount.

3. A truing method for a chamfering grindstone for performing chamfering work on a peripheral edge of a plate-shaped object, comprising the steps of:

performing chamfering work on a truing grindstone with a master grindstone having a desired groove shape and forming a peripheral edge shape of the truing grindstone into a desired chamfered shape; and transferring the groove shape of the master grindstone onto the chamfering grindstone by performing grooving work on the chamfering grindstone with the chamfered truing grindstone to form the groove in the desired shape on the chamfering grindstone; wherein when the grooving work is performed on the chamfering grindstone with the truing grindstone, and the groove shape of the master grindstone is transferred onto the chamfering grindstone, the truing grindstone and the chamfering grindstone are relatively moved to change a transferred shape by a predetermined amount.

4. The truing method for the chamfering grindstone according to claim 2, further comprising the steps of:

performing chamfering work on the peripheral edge of the plate-shaped object by using the trued chamfering grindstone;

measuring the sectional shape of the peripheral edge of the plate-shaped object after the work; and correcting a moving amount of the relative movement in accordance with a measured value of the sectional shape.

5. A chamfering device for performing chamfering work on a peripheral edge of a plate-shaped object, comprising:

a master grindstone and an outer periphery rough grinding grindstone for roughly chamfering the peripheral edge of the plate-shaped object and has a desired groove shape are provided on a common axis;

a truing grindstone and a mounting table which rotates with the plate-shaped object placed on the mounting table are provided on a common rotational axis; and a fine grinding grindstone which performs finish chamfering of the peripheral edge of the plate-shaped object, wherein chamfering work is performed on the truing grindstone with the master grindstone and the peripheral edge shape of the truing grindstone is formed into a desired chamfered shape;

wherein the groove shape of the master grindstone is transferred onto the fine grinding grindstone by performing grooving work on the fine grinding grindstone with the chamfered truing grindstone to perform truing for forming the groove in a desired shape on the fine grinding grindstone; and wherein the finish chamfering of the peripheral edge of the plate-shaped object is performed with the trued fine grinding grindstone.

6. The chamfering device according to claim 5, further comprising:

a controller for relatively moving the master grindstone and the truing grindstone to change the transferred shape by a predetermined amount when the chamfering work is performed on the truing grindstone with the master grindstone, and the sectional shape of the groove formed on the master grindstone is transferred as the sectional shape of the peripheral edge of the truing grindstone.

7. The chamfering device according to claim 5, further comprising:

a controller for relatively moving the truing grindstone and the fine grinding grindstone to change the transferred shape by a predetermined amount when the grooving work is performed on the fine grinding grindstone with the truing grindstone, and the groove shape of the master grindstone is transferred onto the fine grinding grindstone.

8. The chamfering device according to claim 6, further comprising:

a measuring machine for measuring the sectional shape of the peripheral edge of the plate-shaped object after the chamfering work, wherein the controller corrects the moving amount of the relative movement in accordance with a measured value of the sectional shape.

* * * * *